United States Patent [19]

Achelpohl et al.

[11] 4,086,742

[45] May 2, 1978

[54] METHOD AND APPARATUS FOR FULLY AUTOMATICALLY FILLING SACKS OR BAGS MADE DURING FILLING FROM A WEB OF TUBULAR PLASTICS FILM

[75] Inventors: Fritz Achelpohl; Konrad Tetenborg, both of Lengerich, Germany

[73] Assignee: Windmöller & Hölscher, Lengerich, Germany

[21] Appl. No.: 771,745

[22] Filed: Feb. 24, 1977

[30] Foreign Application Priority Data

Mar. 1, 1976 Germany ..... 2608456

[51] Int. Cl.[2] ..... B65B 1/02; B65B 3/02; B65B 43/00

[52] U.S. Cl. ..... 53/29; 53/183; 53/187

[58] Field of Search ..... 53/29, 179, 183, 187, 53/386, 387, 388

[56] References Cited

U.S. PATENT DOCUMENTS

| | | | |
|---|---|---|---|
| 3,112,588 | 12/1963 | Barraclough | 53/187 |
| 3,201,914 | 8/1965 | Lohse et al. | 53/187 |
| 3,948,019 | 4/1976 | Döring | 53/183 X |

*Primary Examiner*—Robert Louis Spruill
*Attorney, Agent, or Firm*—Fleit & Jacobson

[57] ABSTRACT

Bags are fabricated from tubular plastics film as they are being filled. A flattened severed tube section of the bag material is clamped across its entire width at the bottom but only near the folded longitudinal edges (or the side pleats if such are provided) at the top. The walls of the tube section are pulled apart at the top between the clamped regions to present a filling aperture and welded together at the bottom across the entire width below the clamped region. After the contents of the bag have been inserted through the filling aperture, the top of the tube section is welded shut above the clamped regions and the bag is discharged.

14 Claims, 8 Drawing Figures

METHOD AND APPARATUS FOR FULLY AUTOMATICALLY FILLING SACKS OR BAGS MADE DURING FILLING FROM A WEB OF TUBULAR PLASTICS FILM

The invention relates to a method, and to apparatus for performing this method, of fully automatically filling sacks or bags made during filling from a web of tubular plastics film, wherein tube sections provided with base seams are opened at the top, filled and the opened edges are pulled together and welded to each other.

It is known (German registered design No. 7 432 327, German patent Application No. 1 948 227) to store in magazines sacks that have been made from tube sections by applying base weld seams, to take the sacks from the magazines for the purpose of filling them, and to close the filled sacks by welding the upper margins of the aperture. This known method of making filled sacks is expensive because first of all sacks with bases have to be made, the sacks have to be stacked, the stacks have to be stored, dispatched and accumulated in magazines for filling purposes and the sacks finally have to be withdrawn from the magazines individually in order to be filled and closed during subsequent operations.

According to a more economical method, therefore, bags or sacks open at one end are no longer prefabricated, instead, they are made in conjunction with being filled, a web of tubular film being withdrawn from a reel and tube sections being severed therefrom to be made into sacks.

In a method of the aforementioned kind known from German patent application No. 2 301 817, a web of tubular film withdrawn from a supply reel has its leading end closed by a transverse weld seam at a first station and from this a section of the desired length of sack is severed. At a second station comprising displaceable clamping jaws for holding the side folds of the sack, suction nozzles for opening the free side walls of the sack, an insertable filling nipple and means for lifting and lowering the sack, the latter is filled with filling material. At a third station, the filling end of the filled sack is closed by a weld seam and at a fourth station the filled and closed sack is discharged. The four stations are disposed at a fixed location on a circumference of a rotary spider which is provided with four sack supports and conveying cheeks for transporting the sacks from one station to the other. This known method of making filled sacks has the disadvantage that the time available for making and cooling the base weld seam corresponds only to the period of one cycle of the conveying spider. At the filling station following the welding station, the base weld seam is therefore often insufficiently set to withstand the load of the filled material caused by its momentum and weight. Further, the sacks can be filled only while the conveying spider is at a standstill. To avoid the danger of tearing the sacks and to provide sufficient time for filling them, the machine must run more slowly to achieve longer cycle periods, but this permits only lower outputs to be achieved.

To obtain a high strength for the seam and adequate cooling of the beam seam extending over several operating cycles before the sack is opened, applied to a filling nipple and filled, it is known from German patent application No. 2 418 228 to provide a synchronously operating conveyor between the welding and cutting station and the filling station; during several operating cycles, the conveyor takes the sacks with welded base seams in an unstressed condition to the filling station. The length of the conveying path is such that a sufficiently long cooling period is available for the welded seams. In this known apparatus, the cycle period is again limited by the welding time for the base seam, so that the output of the machine cannot be increased to any desired extent.

It is therefore an object of the present invention to provide a method of making filled bags or sacks at a high output without the danger of overstressing the fresh weld seams.

This object is achieved in accordance with the invention in a method of the aforementioned kind in that a tube section is severed from the web of tubular plastics film and clamped along its width at the bottom and only in the region of its folds transversely to the longitudinal axis of the tube section at the top, that the walls of the tube section are pulled, apart at the top between the clamped regions and transversely welded along its entire width at the bottom below the clamping position, that the filling material is introduced, the upper end of the tube section is closed by stretching the side walls and provided with a transverse weld seam above the clamping position, that the clamping is released and the filled sack is deposited. According to the method of the invention, the freshly produced welded base seem is not loaded by the filling because the filling pressure as well as the weight of the filling is taken up by the clamping, so that the welded base seam remains unstressed until it has cooled off and solidified. A machine operating according to the method of the invention can be operated with a high output because the base weld seam can be produced during filling of the sack without being loaded and it can cool off and the filling time is not governed by the cycle of the machines. The weld seam for closing the sack is likewise relieved by the clamping of the marginal zones at the filling end while it is being applied, so that it has achieved adequate strength by the time the clamping is released.

For a tube section with side folds, the filling end is clamped only in the region of the side folds. The side folds are thereby fixed at the upper edge of the bag section so that the latter can be cleanly and reliably displaced by a transverse weld seam after tightening of the clamps.

An apparatus for carrying out the method of the invention comprises conveyor means intermittently movable about a vertical shaft in equal angular steps of a fraction of one complete revolution, means fixed with respect to the frame for severing the tube sections and supplying them for filling as well as taking away the filled sacks or bags, and means for applying base and top seams to the tube sections as well as opening and clamping means and is characterized according to the invention in that each conveying means consist of at least one conveyor arm on which there are arranged jaws for clamping the lower edges of the tube sections fed thereto as well as jaws which clamp the upper edges of the aperture in the region of the folded edges and are movable to vary the spacing therebetween, that the upper and lower clamping jaws are movable towards and away from one another, that welding means are provided on the arms for applying top and bottom weld seams respectively above the upper and below the lower clamping jaws, and that each conveyor arm carries a filling funnel moving therewith. In the apparatus according to the invention, the clamping, welding and tightening means are moved with the associated filling funnels through the means that are separated from one another by one angular step for transferring the tube sections severed from the web of tubular film as well as for discharging the filled sacks. The tube section delivered by the transfer means to the clamping and welding station that just happens to be at the transfer means is welded at this station over the entire width of the base and clamped in the region of the side folds at the filling end and remains in this clamped position at the bottom as well as the top while passing through all the angular steps. After further rotation of the clamping and welding station through one angular step, the pairs of clamping jaws of the upper clamping means are moved towards one another and the upper walls of the single aperture are opened with the assistance of suckers that are movable away from one another and the lower weld means are actuated to produce the lower weld seam. After opening the single aperture, the proportioning means disposed one angular step behind the transfer means are opened and the filling material is introduced through the filling funnel to the tube section that is clamped at the bottom. The emptying process from the proportioning means to the filling funnel occurs very rapidly by reason of the large cross-section of the outlet aperture of the proportioning means, in any case during a time that is shorter than the time during which the clamping and welding station is in its filling position. Filling material still disposed in the filling funnel and not yet delivered to the bag can be emptied into the opened tube section even during the subsequent machine cycle. Welding of the base is initiated by closing the welding jaws directly after transfer of the tube section. The weld seam can cool off during the subsequent angular steps until the filled bag is discharged.

When the filling funnel has been emptied into the tube section, for example after the third angular step, the filling aperture is closed by a tensioning movement of the upper clamping jaws and welded by welding jaws that are brought up. The upper weld seam can cool off during the last angular steps until the filled bag is discharged. By reason of the fact that each clamping and welding station has its own filling funnel, the filling operation can extend over several angular steps and the cycle period can be kept very short.

Further advantageous embodiments of the invention are described in more detail in the subsidiary claims.

An example of the invention will now be described in more detail with reference to the drawing, wherein.

Figure 1:
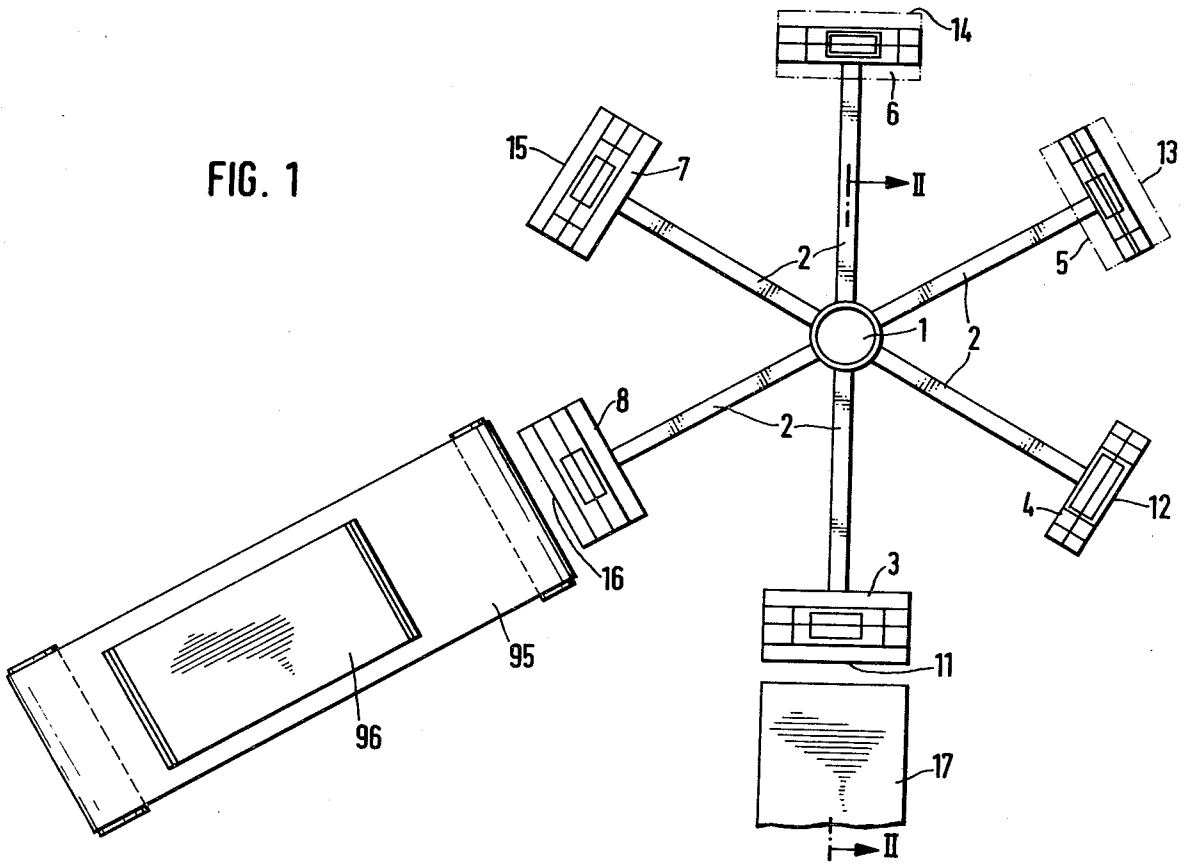
FIG. 1 is a diagrammatic plan view of the apparatus for making filled sacks.
Figure 2:
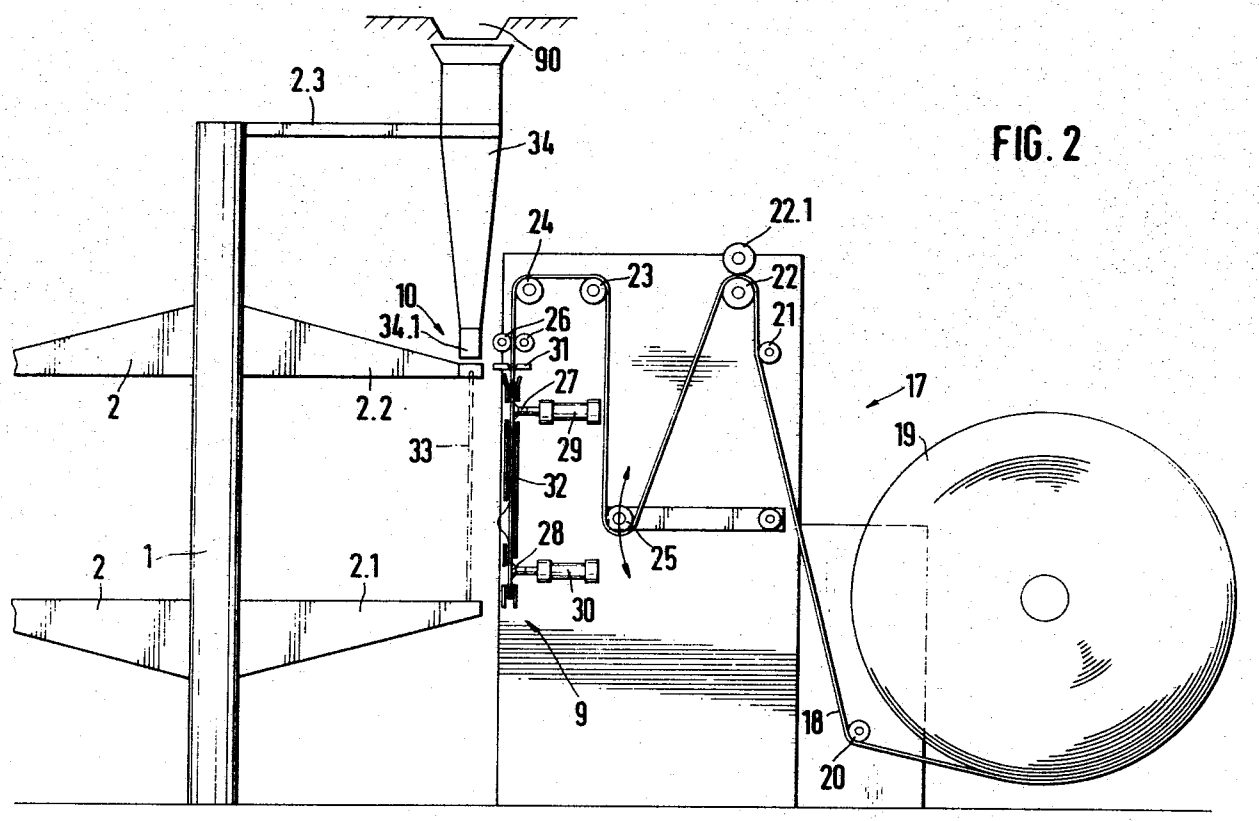
FIG. 2 is a section on the line II—II in FIG. 1.

FIG. 1 is a plan view of an apparatus for forming sacks with side pleats and for filling, closing and discharging the filled sacks. A central tube 1 is rotatably mounted on a vertical shaft fixed with respect to the frame and is set into intermittent rotation of six steps per revolution by means of a motor (not shown). The stepping speed and the pauses after each step are adjustable. Eighteen horizontal arms 2 extend radially outwardly from the central tube 1 and carry a total of six stations 3 to 8 at equal spacings distributed over the periphery. Every six of the eighteen arms 2 are superposed in levels and designated 2.1, 2.2 and 2.3. By means of the intermittent rotation of the central tube 1, each station arrives at the position previously assumed by the adjacent station, so that the six stations 3 to 8 pass consecutively through all six possible positions 11 to 16. All the stations 3 to 8 are of similar construction, clamping and welding means 9 for the base seam being connected to each of the lower arms 2.1, clamping, spreading and welding means 10 for the top seam being connected to each of the central arms 2.2 and a filling funnel 34 being connected to each of the upper arms 2.3. At the position 11, take-off, severing and transfer means 17 are disposed opposite the passing stations; they withdraw from a supply reel 19 a tube 18 that is laid into side folds, sever one section, and transfer the tube section to one of the stations 3 to 8 that happens to be at the position 11. The tube 18 is fed over guide rollers 20, 21 and 23, 24 and over a jockey roller 25 and is continuously withdrawn by a pair of tension rollers 22, 22.1 and intermittently fed by a pair of tension rollers 26 until its leading end is suspended at the level of the clamping and welding means 9 of the respective station. In this position, it is engaged by two superposed rows of suckers 27, 28 which are movable in a horizontal direction by means of piston-cylinder pressure medium units 29, 30. The tube 18 is then severed by a severing knife 31 disposed at the level of the clamping, spreading and welding means 10. By actuating the piston-cylinder pressure medium units 29, 30, the tube section 32 held by the suckers 27, 28 is moved into the operating plane 33 of the means, 9, 10 of the stations 3 to 8 and engaged by the clamping tools of these means.

Figure 3:
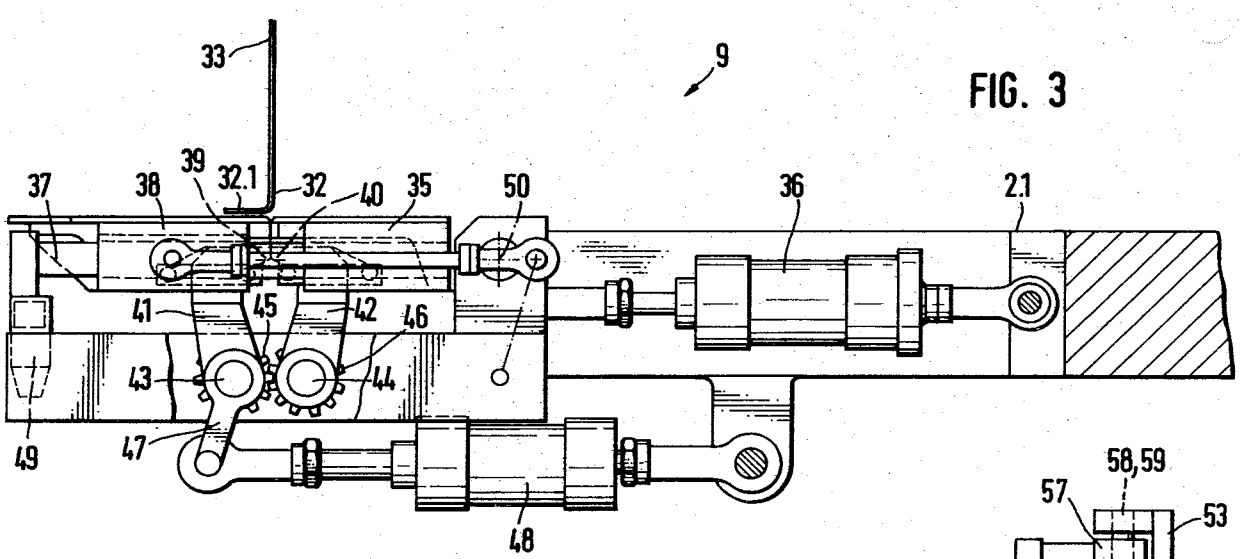
FIG. 3 is a side elevation of the lower clamping and welding means.
Figure 6:
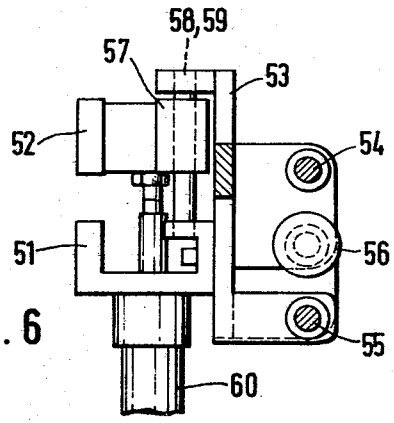
FIG. 6 is a section on the line VI—VI in FIG. 5.
Figure 4:
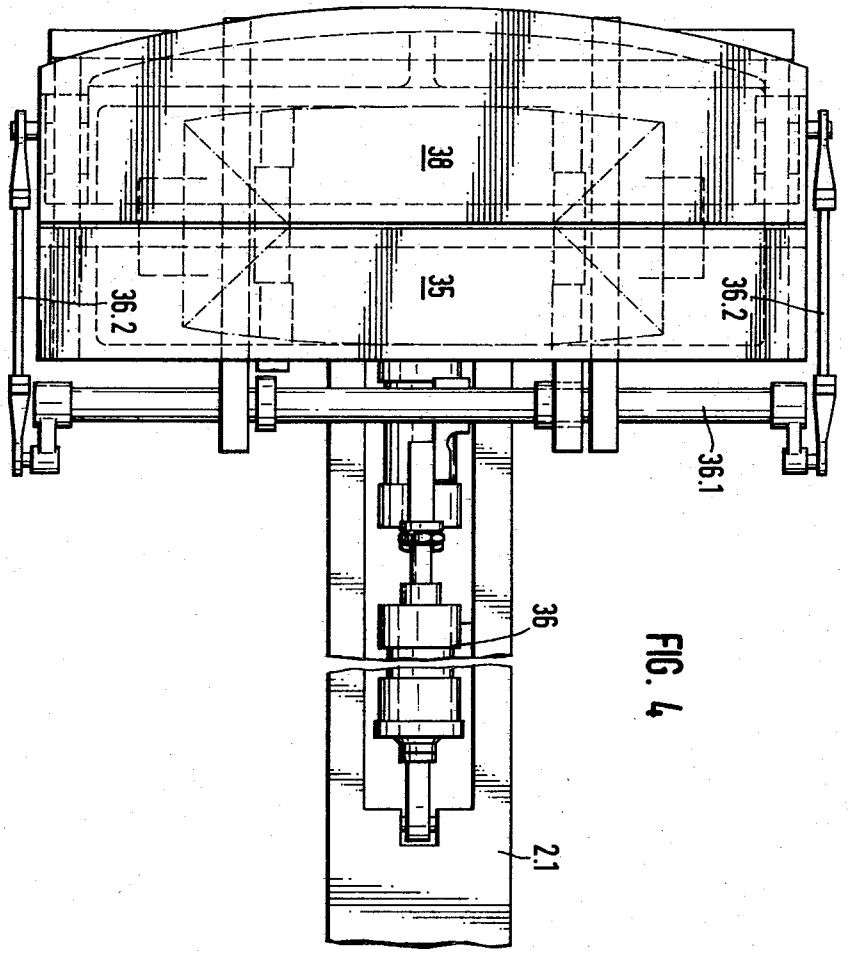
FIG. 4 is a plan view of the lower clamping and welding means.
Figure 5:
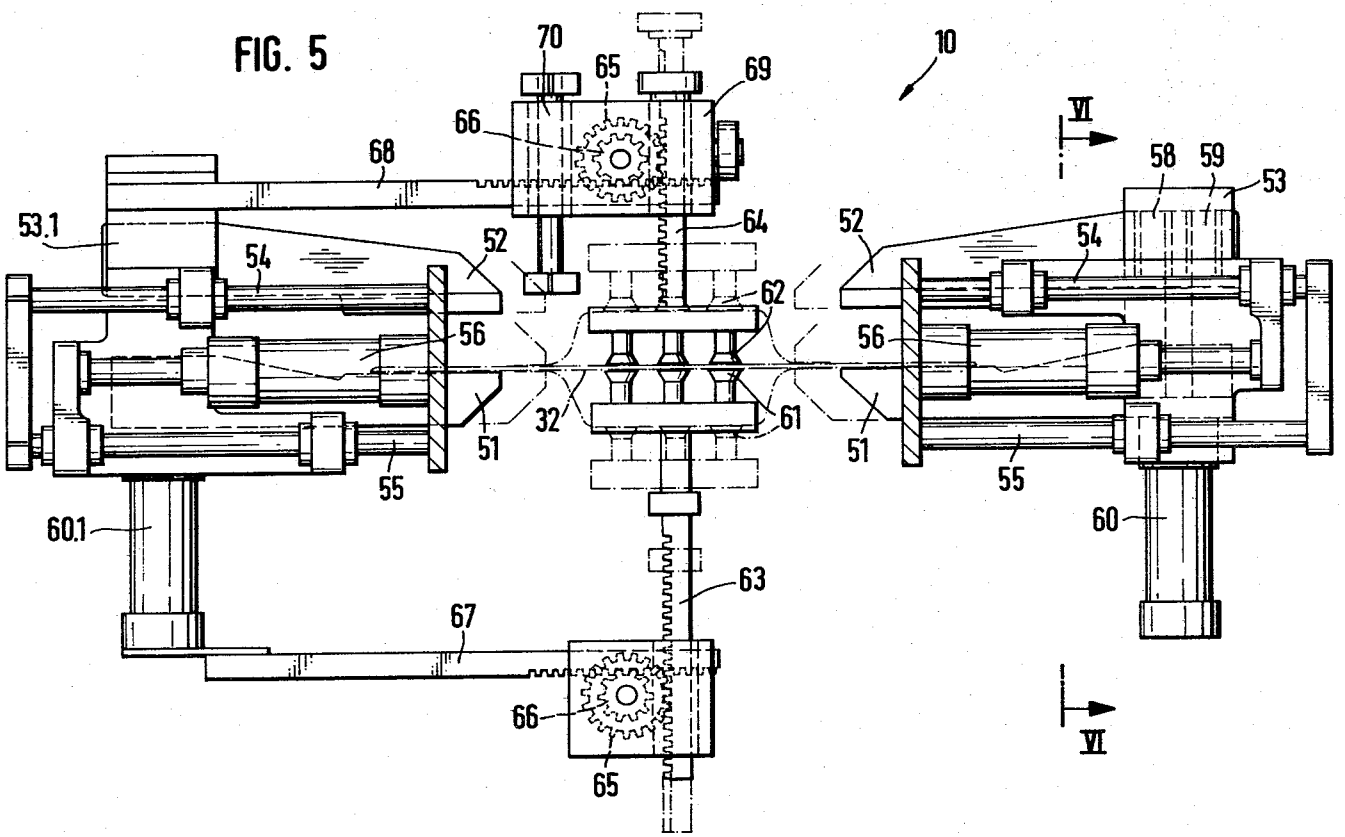
FIG. 5 is a plan view of the upper clamping and spreading means.
Figure 7:
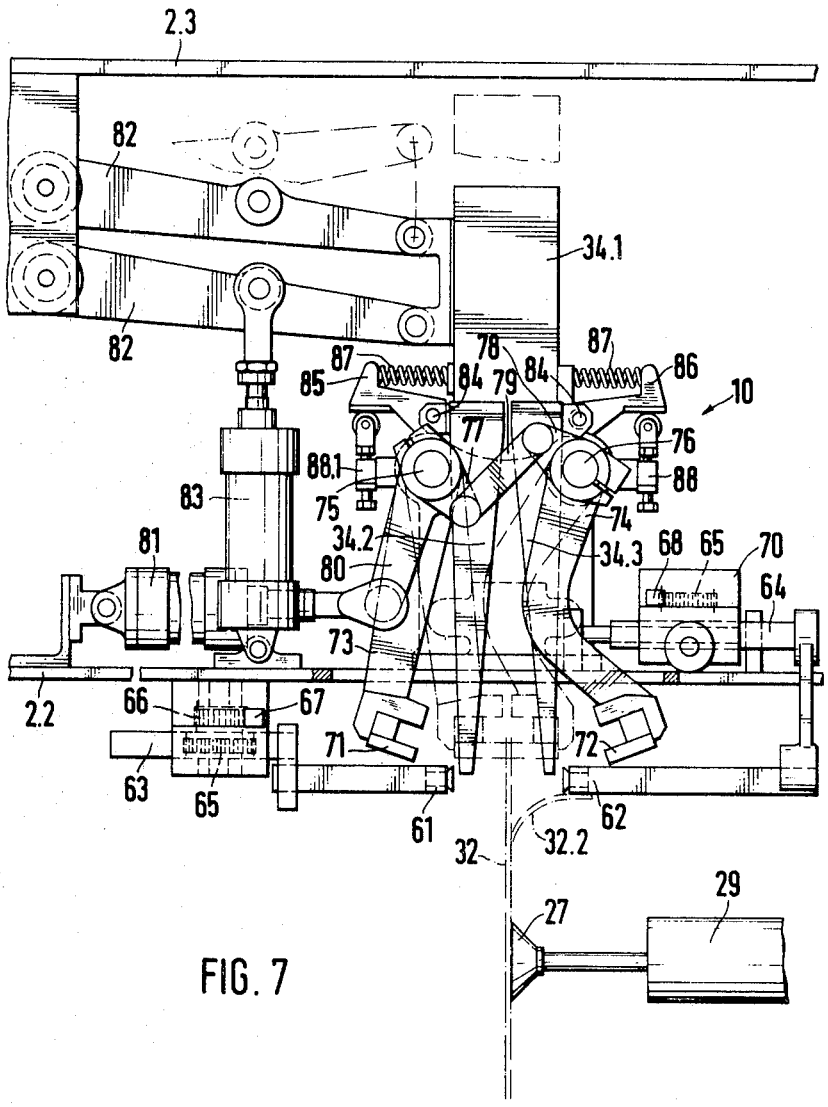
FIG. 7 is a front elevation of the upper clamping, welding and spreading means.
Figure 8:
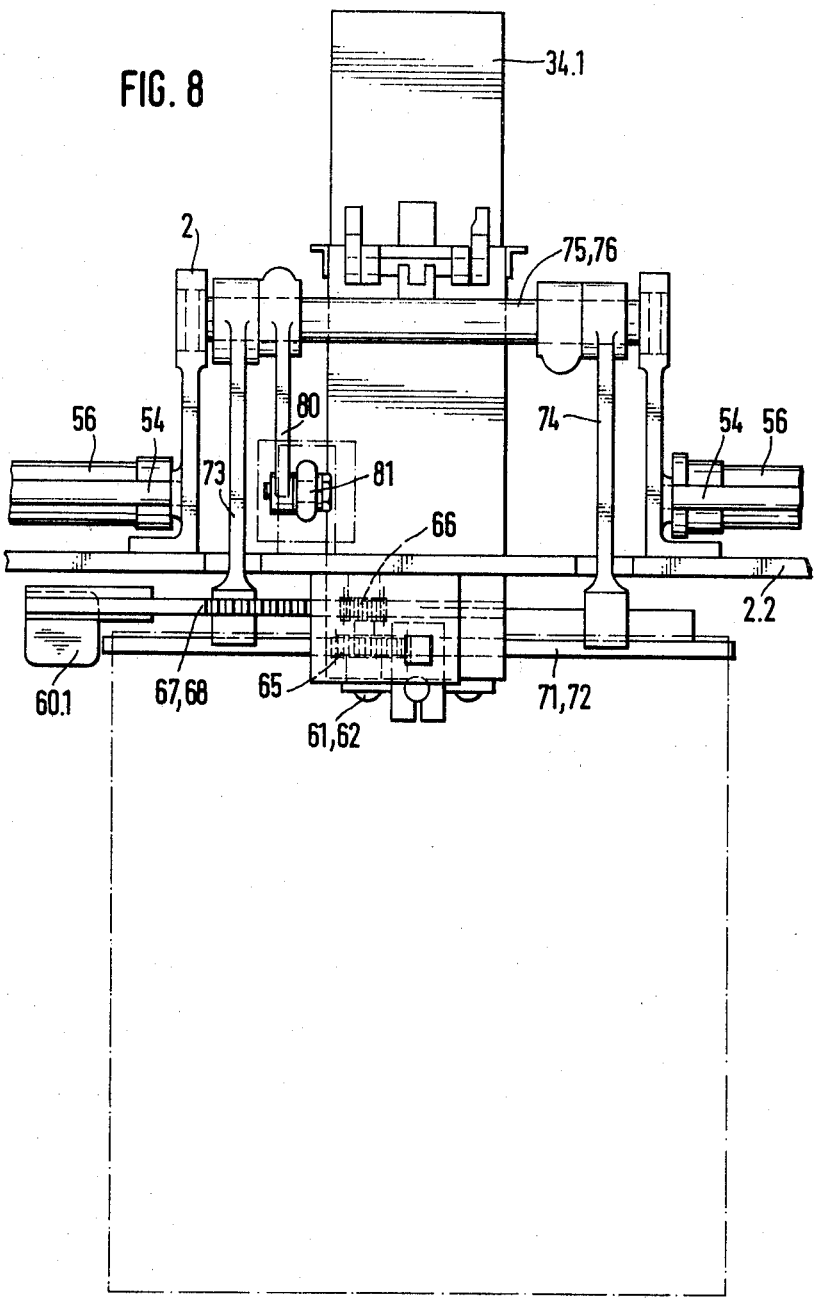
FIG. 8 is a side elevation of the means shown in FIG. 5.

FIG. 3 is a side elevation and FIG. 4 a plan view of the clamping and welding means 9 that engage the lower end of the tube section and are held by the lower arm 2.1. They consist of a clamping jaw 35 which is secured to the arm 2.1 and is fixed in relation to its backing jaw and a clamping jaw 38 which is mounted in guides 37 and is movable towards and away from the clamping jaw 35 by a piston-cylinder pressure medium unit 36 acting for example by way of a shaft 36.1 and push member 36.2, as well as a pair of welding jaws 39, 40 secured to levers 41, 42 that are rotatable about shafts 43, 44. The shafts 43, 44 are secured in the arm 2.1. Fixed to the levers 41, 42 there are pinions 45, 46 which are in mesh with one another. In addition, there is connected to the lever 41 a lever 47 of which the free end is hinged to the piston rod of a piston-cylinder pressure medium unit 48. The cylinder of the piston-cylinder pressure medium unit 48 is pivoted to the arm 2.1. On actuation of the piston-cylinder pressure medium unit 36 or 48, the clamping jaws 35, 38 or the welding jaws 39, 40 are closed or opened.

The clamping jaws 35, 38 can be swung upwardly about a pivot 50 by means of a handle 49 so that the welding jaws 39, 40 therebelow are readily accessible.

The clamping jaws 35, 38 and the welding jaws 39, 40 extend over the entire width of the sack to be processed. On transfer of the tube section 32 from the take-off, severing and transfer means 17, the lower portion of the tube section 32 is lifted by the amount by which the sack is shortened relatively to the tube section because of the filling. The lower end 32.1 which is to be engaged by the clamping and welding jaws 35, 38 or 39, 40 is bent rearwardly during transfer. The lower end 32.1 falls in the plane 33 under its own weight into the gap between the clamping jaws 35 and 38 or the welding jaws 39 and 40, this gap being kept sufficiently large for this purpose.

The upper end of the tube section 32 engaged by the suckers 27, 28 and moved into the operating plane 33 by the piston-cylinder pressure medium units 29, 30 is engaged and clamped in the region of its side folds in accordance with FIGS. 5 to 8 by clamping jaws 51, 52 of the clamping, spreading and welding means 10 held by the central arms 2.2. The clamping jaws 51 are fixed to carriages 53 or 53.1 which can be reciprocated on fixed guide pins 54, 55 by means of piston-cylinder pressure medium units 56. The clamping jaws 52 are connected to guide carriages 57 which can be reciprocated on guide pins 58, 59 by piston-cylinder pressure medium units 60 to 60.1. By means of the piston-cylinder pressure medium units 60 or 60.1, the clamping jaws 52 are moved towards and away from the clamping jaws 51. On actuation of the piston-cylinder pressure medium units 56, the pairs of clamping jaws 51, 52 are moved towards and away from one another. Between the pairs of clamping jaws 51, 52 there are rows of suckers 61, 62 connected to respective racks 63, 64 which mesh with teeth 65 of the pairs of pinions 65, 66. The teeth 66 are in mesh with racks 67, 68. The latter are rigidly connected to the left-hand carriage 53.1 or the left-hand piston-cylinder pressure medium unit 60.1.

The pair of pinions 65, 66 in mesh with the racks 63 or 67 is mounted to be fixed with respect to the frame. The pair of pinions 65, 66 in mesh with the racks 64 or 68 is mounted in a bearing block 69 displaceable on guide pins 70 that are fixed with respect to the frame. During closing movement of the clamping jaws 52, suckers 62 are moved in synchronism in that the rack 68 transmits this movement, it being appropriately guided for this purpose in the bearing block 69. When the clamping jaws 51, 52 have clamped the tube section 32, both rows of suckers 61, 62 lie against the walls of the tube section 32 at the right and left-hand sides. On actuation of the piston-cylinder pressure medium units 56, the pairs of clamping jaws 51, 52 move towards one another and the rows of suckers 61, 62 move to the spread position under the action of the racks 67, 68 and 63, 64 with simultaneous application of the suction air. This causes the side fold portions to move towards one another and the tube wall portions therebetween to move apart so that the filling aperture of the tube section becomes spread.

Above the rows of suckers 61, 62 there are welding jaws 71, 72 fixed to levers 73, 74. These are mounted on shafts 75, 76 that are fixed with respect to the frame. Secured to the levers 73, 74 there are short arms 77, 78 of which the ends are interconnected by a lug 79. A further lever 80 is secured to the lever 73 of which the end is hinged to the piston rod of a piston-cylinder pressure medium unit 81. The cylinder of the piston-cylinder pressure medium unit 81 is pivoted to the arm 2.2. The system of levers 73 to 80 is designed so that, on actuation of the piston-cylinder pressure medium unit 81, both welding jaws 71, 72 move towards or away from one another. In the same way as the lower end 32.1, the upper end 32.2 is likewise bent rearwardly by the rows of suckers 27, 28 during the transfer. Under its inherent stiffness, it swings upwardly between the clamping or welding jaws.

Between the welding jaws 71, 72, the movable end 34.1 of the filling funnel 34 secured to the arm 2.3 can be lowered and lifted. For this purpose the funnel end 34.1 is hinged to parallel levers 82 which are pivoted to the funnel end 34.1 on the one hand and to the arm 2.3 on the other hand. The piston rod of a piston-cylinder pressure medium unit 83 is hinged to one of the levers 82, the cylinder being pivoted to the arm 2.2. The funnel beak segments 34.2 and 34.3 are connected to the funnel end 34.1 by pivots 84. Levers 85, 86 are secured to the funnel back segments 34.2 and 34.3. Springs 87 keeping the funnel beak 34.2, 34.3 closed are stretched between the levers 85, 86 and the side walls of the funnel end 34.1. Push members 87, 88 are fixed to the levers 73, 74 and the levers 85, 86 run up against them when the funnel end 34.1 is lowered and introduced in the opened filling end of the tube section 32. On termination of the filling operation, the funnel end 34.1 is raised by actuating the piston-cylinder pressure medium unit 83, the funnel beak 34.2, 34.3 closing again. The pairs of clamping jaws 51, 52 are then moved apart again to the starting position shown in full lines by actuating the piston-cylinder pressure medium units 56 and simultaneously switching off the suction air of the rows of suckers 61, 62. By actuating the piston-cylinder pressure medium unit 81, the welding jaws 71, 72 are finally moved towards one another and the tube section 32 is provided with the top seam.

The function of the apparatus will now be described for one revolution of the central tube 1 while, say, station 3 intermittently passes through all positions 11 to 16. At position 11, the tube section unwound and severed by the take-off, severing and transfer means 17 is transferred to the welding and spreading means 9, 10 of station 3 and clamped at the end of the base by the clamping jaws 35, 38 and at the top end by the pairs of clamping jaws 51, 52. On further rotation of the central tube 1 through one sixth of one revolution, station 3 reaches the position 12. In this position there are proportioning means 90 which are arranged above the plane of the filling funnel 34 and by means of which the filling material is weighed and apportioned to the filling funnels 34. The discharge opening of the proportioning means 90 is designed to be so large that the filling material is emptied into the filling funnel 34 during a fraction of one standstill period. At position 12 the filling aperture of the tube section 32 is opened in the above-described manner and filling commences after lowering of the funnel end 34.1. In this position the lower welding jaws 39, 40 are also swung towards the tube section 32 and welding of the base seam commences.

During further rotation, station 3 arrives at the position 13. In its passage to this location, and while in position 13, the filling material from the funnel 34 continues to reach the tube section 32. The filling operation is terminated at position 13. The filling funnel end 34.1 is thereupon lifted and the filling aperture is closed and stretched by moving the pairs of clamping jaws 51, 52 apart. Welding of the top seam now starts by swinging the welding jaws 71, 72 into position.

At position 14, the welding jaws 39, 49 open and the base seam can cool off. The cooling operation can possibly be accelerated by a fan. Welding of the top seam continues at position 14.

At position 15, the upper welding jaws 71, 72 are also opened and the top seam cools off. At position 16, the clamping jaws 35, 38 and 51, 52 open and the filled sack 96 is, upon further rotation of the station 3, pushed onto a conveyor belt 95 in an upright position in order to protect the top seam and it is taken away by the conveyor belt.

Station 3 now again arrives at position 11 and the cycle is repeated. During the single revolution of station 3, the other stations 4 to 8 are likewise intermittently rotated and their means 9, 10 function in the same way as described for the means of station 3.

We claim:

1. A method of fully automatically filling sacks or bags made during filling from a web of tubular plastics film comprising:

severing a tube section having folds, from a web of tubular plastics film;

clamping a bottom section of the severed tube section along its width at its bottom;

clamping top portions of the severed tube section at its top only in the region of the folds and transversely to the longitudinal axis of the severed tube section;

pulling the side walls of the severed tube section apart between the clamped top portions;

transversely welding the bottom of the severed tube section along its entire width below the clamped bottom section;

introducing filling material through the pulled apart side walls;

closing the top of the severed tube section by stretching the side walls thereof;

transversely welding the top of the severed tube section above the clamped top portions; and releasing the clamping of the bottom section and the top portions of the severed tube section and depositing the filled sack.

2. A method according to claim 1, characterized in that for a tube section with side folds, top portions are clamped only in the region of the side folds.

3. An apparatus for fully automatically filling sacks or bags made during filling from a web of tubular plastics film comprising:

(a) a vertical rotary shaft;

(b) fixed tube severing, supplying and take-away means for severing tube sections having folded edges, from the web of tubular plastics, for supplying the severed tube sections for filling; and for taking away the filled tube sections;

(c) a plurality of conveying means intermittently movable about said vertical shaft past said fixed means in equal angular steps of a fraction of one complete revolution, and comprising:

(1) conveyor arm means, (2) lower clamping means on said conveyor arm means including a set of lower jaws for clamping the bottom portion of a severed tube section along its width, (3) upper clamping means on said conveyor arm means including two sets of upper jaws for clamping the upper portions of a severed tube section in the region of its folded edges, said two sets of upper jaws being movable towards and away from each other to vary the spacing therebetween, (4) welding means on said conveyor arm means for applying top and bottom weld seams, respectively, above the sets of upper and below the set of lower clamping jaws, and (5) a filling funnel carried by and moving with said conveyor arm means.

4. Apparatus according to claim 3, characterized in that the welding means includes a pair of welding jaws, two levers for supporting the jaws, pinions fixed to the levers and engaging one another, a third lever fixed at one end to one of the two levers supporting the jaws, and a piston-cylinder pressure medium unit having its piston rod hinged to the other end of the third lever.

5. Apparatus according to claim 3, characterized in that the upper clamping means includes piston-cylinder pressure medium units for moving one of the sets of clamping jaws towards and away from the other set of clamping jaws and rows of suckers operable by the movement of the clamping jaws, and the welding means includes movable welding jaws and a piston-cylinder pressure medium unit for moving the welding jaws to an operative position.

6. Apparatus according to claim 5, characterized in that racks and pinions are provided for operating the rows of suckers.

7. Apparatus according to claim 6, characterized in that the racks are fixed to the movable set of clamping jaws.

8. Apparatus according to claim 3, characterized in that the number of angular steps about the vertical shaft per revolution corresponds to the number of conveying arm means.

9. Apparatus according to claim 3, characterized in that six conveyor arm means are provided, means for clamping and welding with associated filling funnels being arranged on each arm means, the arm means being arranged in spider form at equal angular spacings about the vertical rotary shaft.

10. Apparatus according to claim 3, characterized in that the tube severing and tube section transfer means comprise two superposed rows of suckers which are movable horizontally by piston-cylinder pressure units, engage the tube section and move same into the operating plane of the the lower clamping means and the upper clamping means.

11. Apparatus according to claim 3, characterized in that the lower clamping means comprises a first clamping jaw fixed with respect to a counterjaw and a second clamping jaw movable in guides towards and away from the first clamping jaw by means of a piston-cylinder pressure medium unit, and said welding means comprises welding jaws and levers for securing the welding jaws, the levers being rotatably mounted about shafts.

12. Apparatus according to claim 3, characterized in that the filling funnel has a funnel end, and a piston-cylinder pressure medium unit is operatively associated with the filling funnel for moving the funnel end into and out of the filling aperture of the spread tube section.

13. Apparatus according to claim 3, characterized in that the filling funnel has a funnel end including the funnel back segments connected to the funnel end by pivots.

14. Apparatus according to claim 13, characterized in that the funnel beak segments are spreadable by levers that run up against push members.

* * * * *